US010718583B2

(12) United States Patent
Michael

(10) Patent No.: US 10,718,583 B2
(45) Date of Patent: Jul. 21, 2020

(54) HIGH CAPACITY FIREARM MAGAZINE

(71) Applicant: VISTA OUTDOOR OPERATIONS LLC, Farmington, UT (US)

(72) Inventor: Christopher J. Michael, Belgrade, MT (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/261,701

(22) Filed: Jan. 30, 2019

(65) Prior Publication Data

US 2019/0162497 A1 May 30, 2019

Related U.S. Application Data

(63) Continuation of application No. 15/621,671, filed on Jun. 13, 2017, now Pat. No. 10,234,221.

(60) Provisional application No. 62/349,528, filed on Jun. 13, 2016.

(51) Int. Cl.
*F41A 9/70* (2006.01)

(52) U.S. Cl.
CPC ..... *F41A 9/70* (2013.01)

(58) Field of Classification Search
CPC ..... F41A 9/61; F41A 9/65
USPC ..... 42/49.01, 50
See application file for complete search history.

(56) References Cited

PUBLICATIONS

Product listing for Savage A-series Magazine; ButlerCreek.com [https://www.butlercreek.com/products/magazines/savage-a-series-magazine ] (Year: 2020).*

* cited by examiner

*Primary Examiner* — Samir Abdosh
(74) *Attorney, Agent, or Firm* — Walter M. Egbert, III; Gerard M. Donovan; Reed Smith LLP

(57) ABSTRACT

A high capacity magazine for high powered rimfire cartridges comprises a header portion that has a form factor to be received in a rotary magazine receptacle and an arcuate cartridge bank portion that holds a column of cartridges. A pair of clamshell halves define an arcuate cartridge bank and a lower portion of the header potion. A header caps the upper ends of the clamshell haves securing the clamshell halves together. The head and clamshell halves define the cartridge pathway to the magazine exit to be fed into the rifle chamber.

7 Claims, 19 Drawing Sheets

HIGH CAPACITY FIREARM MAGAZINE

RELATED CASE INFORMATION

This application is a continuation of U.S. application Ser. No. 15/621,671, filed on Jun. 13, 2017 which claims the benefit of Provisional Application No. 62/349,528, filed on Jun. 13, 2016. All of which are incorporated herein, in their entireties.

BACKGROUND OF THE DISCLOSURE

In shooting sports, high-performance low-cost ammunition is highly desirable. High 5 performance can mean, for example, high accuracy at long ranges. Traditionally, center fire cartridges provide such performance, but, they are relatively expensive. Rimfire cartridges have provided inexpensive cartridges with reasonable performance. In recent years, the .17 Horady Magnum Rimfire (.17 HMR) cartridge has become very popular in applications such as varmint hunting. This cartridge produces an extremely high muzzle velocity (e.g., twice the speed of 10 sound), much higher than conventional rimfire cartridges. This high muzzle velocity combined with the relatively low wind resistance of the .17 projectile combine to minimize bullet drop and produce a relatively flat trajectory thus offering the high performance of center fire cartridges at a rimfire price. Rifles that chamber the .17 HMR are commercially available, for example, from Savage Arms, Marlin Firearms and Sturm, Ruger & Company. Such inexpensive high performance cartridges are conducive to high volume firing, especially since a semiautomatic rifle, the model A17, that accepts such cartridges is now available from Savage Arms. The A17, and other rimfire rifles, particularly semiautomatic rimfire rifles, utilize a rotary magazine that fits within a magazine receptacle in such rifles and is within the form factor of the rifles. That is, the exposed surface of the magazine follows the contours of the rifle. Low-cost high capacity magazines are known that plug into the receptacle for the rotary magazines for 22 caliber rimfire cartridges. Improvements to such high capacity magazines to accommodate the larger and higher powered .17 HAIR cartridges would be well received.

SUMMARY

A high capacity magazine for high powered rimfire cartridges comprises a header portion that has a form factor to be received in a rotary magazine receptacle and an arcuate cartridge bank portion that holds a column of cartridges. A pair of clamshell halves define an arcuate cartridge bank and a lower portion of the header potion. A header caps the upper ends of the clamshell haves securing the clamshell halves together. The head and clamshell halves define the cartridge pathway to the magazine exit to be fed into the rifle chamber.

A magazine for holding and dispensing a plurality of cartridges comprises a magazine body including a port body portion and a starboard body portion. The port body portion comprises a front port wall, a rear port wall, and a port side wall extending between the front port wall and the rear port wall. The port body portion further comprises a first port rail and a second port rail that are supported by the port side wall. The starboard body portion comprises a front channel wall, a rear channel wall, and a starboard side wall extending between the front channel wall and the rear channel wall. The inside surfaces of the channel walls define a channel and the starboard side channel wall defines a slot fluidly communicating with the channel, the slot extending through the starboard side channel wall. The starboard body portion further comprises a front starboard wall and a first starboard side wall extending between the front starboard wall and the front channel wall. The front starboard wall supports a first starboard rail of the starboard body portion. The starboard body portion further comprises a rear starboard wall and a second starboard side wall extending between the rear starboard wall and the rear channel wall. The rear starboard wall supports a second starboard rail of the starboard body portion.

The magazine body defines a cartridge receiving volume that is defined in a first dimension between the front and rear walls of the body portions. The cartridge receiving volume is defined in a second dimension between a guiding surface the first rail of the port body portion and a guiding surface of the first rail of the starboard body portion and between a guiding surface of the second rail of the port body portion and a guiding surface of the second rail of the starboard body portion. A follower assembly is slidingly received in the cartridge receiving volume defined by the magazine body. The follower assembly comprises a follower arm and a follower base that are both slidingly received in the cartridge receiving volume defined by the magazine body. The cartridge receiving volume extends along an undulating cartridge path that undulates in a port direction and a starboard direction and the follower arm is pivotally coupled to the follower base so that the follower arm is free to pivot about a pivot axis relative to the follower base as the follower assembly moves along the undulating cartridge path. The follower base comprises a post portion that extends starboardly into the channel defined by the channel walls of the starboard body portion.

The magazine includes a user-accessible lever comprising a button portion, a retaining portion, and a shaft portion extending therebetween. The button portion of the user-accessible lever is disposed outside of the magazine body. The retaining portion of the user-accessible lever engages the base portion of the follower. The shaft portion of the user-accessible lever extends through the slot defined by the starboard side channel wall and through a groove defined by the post portion of the follower base. The follower assembly further comprises a roller disposed about an outer surface of the post and a spring disposed about an outer surface of the roller. The spring comprises a ribbon biased to form a roll when the ribbon is in an unstressed state with no external forces acting thereon. An inner surface of the ribbon defines a central opening when the ribbon is free to form the roll. A roll end of the ribbon is disposed inside the central opening and a coupled end of the ribbon is coupled to the starboard body portion proximate an upper end thereof.

In operation, the ribbon rolls and unrolls during relative translational motion between the follower and the magazine body. The inner surface of the ribbon applies an upwardly directed force to the post of the follower base. The upwardly directed force applied to the roller and the post of the follower base by the inner surface of the ribbon urges the follower in an upward direction. The magazine includes a header disposed at an upward end of the port body portion and the starboard body portion. The header defines a depression. An upward portion of the port body portion and upward portion of the starboard body portion extend into the depression defined by the header.

A magazine for holding and dispensing a plurality of cartridges in accordance with some embodiments comprises a header and a magazine body. The header comprises a starboard header wall disposed opposite a port header wall and a front header wall extending between a forward end of the starboard header wall and a forward end of the port header wall. The header may also include a rearward header wall extending between a rearward end of the starboard header wall and a rearward end of the port header wall. In some embodiments, the header also includes an upper header wall extending between an upper portion of the starboard header wall and an upper portion of the port header wall. The header walls define a header cavity and the upper header wall defining an exit opening communicating with the header cavity in some embodiments. In some embodiments, the magazine body defines a cartridge receiving volume communicating with the exit opening. The magazine body may include a starboard body portion and a port body portion, an upper portion of each body portion extending into the header cavity with the starboard header wall and the port header wall securing the body portions against each other.

In some embodiments, a first guide is fixed to the upper header wall, the first guide extending downwardly beyond a downward facing surface of the upper header wall.

In some embodiments, the first guide extends downward into a guide receiving channel defined by the body portion, the guide receiving channel being dimensioned and configured to receive the first guide. In some embodiments, the first guide has a maximum guide length extending in the portward and starboard directions and a maximum guide width extending in the forward and rearward directions.

The maximum guide length is greater than the maximum guide width in some embodiments. In some embodiments, a first guide and a second guide are fixed to the upper header wall. The guides may extend downwardly beyond a downward facing surface of the upper header wall. In some embodiments, the first guide and the second guide conduct cartridges along an exit path between the cartridge receiving volume and the exit opening. In some embodiments, the exit path extends in a path direction disposed at an angle relative to a vertical reference axis, the vertical reference axis extending in upward and downward directions.

Some embodiments comprise a high capacity magazine for rimfire cartridges, the magazine to be received within a rifle, the rifle configured for accepting a rotary magazine within the rifle at a rotary magazine slot, the high capacity magazine having a head portion sized to be received in the rotary magazine slot, the head portion having a cartridge exit slot, and an arcuate cartridge bank extending downwardly and forwardly from the head portion, the arcuate cartridge bank having an internal open column for receiving a stacked arrangement of rimfire cartridges. In some embodiments, the high capacity magazine comprises a pair of clam shell portions couplable together. When coupled, the clam shell portions define the arcuate cartridge bank and having a pair of upper ends that define a lower portion of the head portion. In some embodiments, the high capacity magazine comprises a header that caps the upper ends of the pair of clam shell portions thereby securing the clam shell portions together. In some embodiments, the high capacity magazine comprises a slider with a cartridge pusher positioned in the internal open column with an externally viewable capacity indicator, and spring connecting between the slider and one of the head portion and arcuate cartridge bank for causing a bias of the slider toward the head portion thereby urging a stack of cartridges in the internal cartridge column toward the cartridge exit slot. A feature and advantage of embodiments is a simple and robust assembly in which a metal header secures together two polymer clam shell portions. The metal header is highly suitable for capturing the ends of the clam shell portions and also provides a metal bearing surface that engages the rifle on insertion into the magazine slot and that provides greatly enhanced wear resistance over conventional polymer surfaces.

A feature and advantage of embodiments is an externally accessible lever that allows a user to reduce or eliminate the biasing force provided by a follower spring. A feature and advantage of embodiments is a magazine body defining an undulating path to be traveled by each cartridge in a stack of cartridges held in the magazine. The undulating nature of the path traveled by each cartridge may alleviate stack up and presentation issues. A feature and advantage of embodiments is a pre-defined track configured to provide smooth translational motion of cartridges as the advance through the magazine. A feature and advantage of embodiments is a two piece follower design including a follower arm that is pivotally coupled to a follower base. This arrangement allows the upper end of the follower arm to travel independently off axis relative to the follower base, spring, and user-accessible lever. The ability of the follower arm to pivot relative to the follower base increased the ability of the follower to travel along an undulating path without excessive friction or binding. A feature and advantage of embodiments is a magazine that is compatible with magazine loader devices, such as, by way of example and not limitation, the magazine loaders shown in the following U.S. patents: U.S. Pat. Nos. 5,301,449, 4,939,862 and 4,739,572. These U.S. patents are incorporated by reference herein.

A feature and advantage of embodiments is a header which engages the upper end of the magazine body at multiple points of contact located at varying heights. With this arrangement, the transition step between the magazine body and the header for the inner ammunition track is less likely to impede or holdup the travel of the cartridges moving upward during feeding or extraction.

A feature and advantage of embodiments is a header which captures the port side portion of the body and the starboard side portion of the body through mechanically interlocking geometry. A feature and advantage of embodiments is a spring that applies a substantially constant upwardly directed feeding for to the base portion of the follower assembly. The spring comprising a ribbon biased to form a roll when the ribbon is in an unstressed state with no external forces acting thereon. An inner surface of the ribbon defining a central opening when the ribbon is free to form the roll. A post of the follower base portion extends through the central opening of the roll so that the inner surface of the ribbon applies an upwardly directed force to the outside surface of the post. In an embodiment, the ribbon is sufficiently thin that the geometry of the roll near the post remains nearly constant as the ribbon rolls and unrolls and the force applied to the outer surface of the post by the inner surface of the ribbon is nearly constant.

DESCRIPTION OF THE FIGURES

FIGS. 14A-14F are located and oriented in a manner consistent with engineering drawings including multiple orthographic projection views;

FIGS. 15A-15F are located and oriented in a manner consistent with engineering drawings including multiple orthographic projection views;

DETAILED DESCRIPTION

Figure 1:
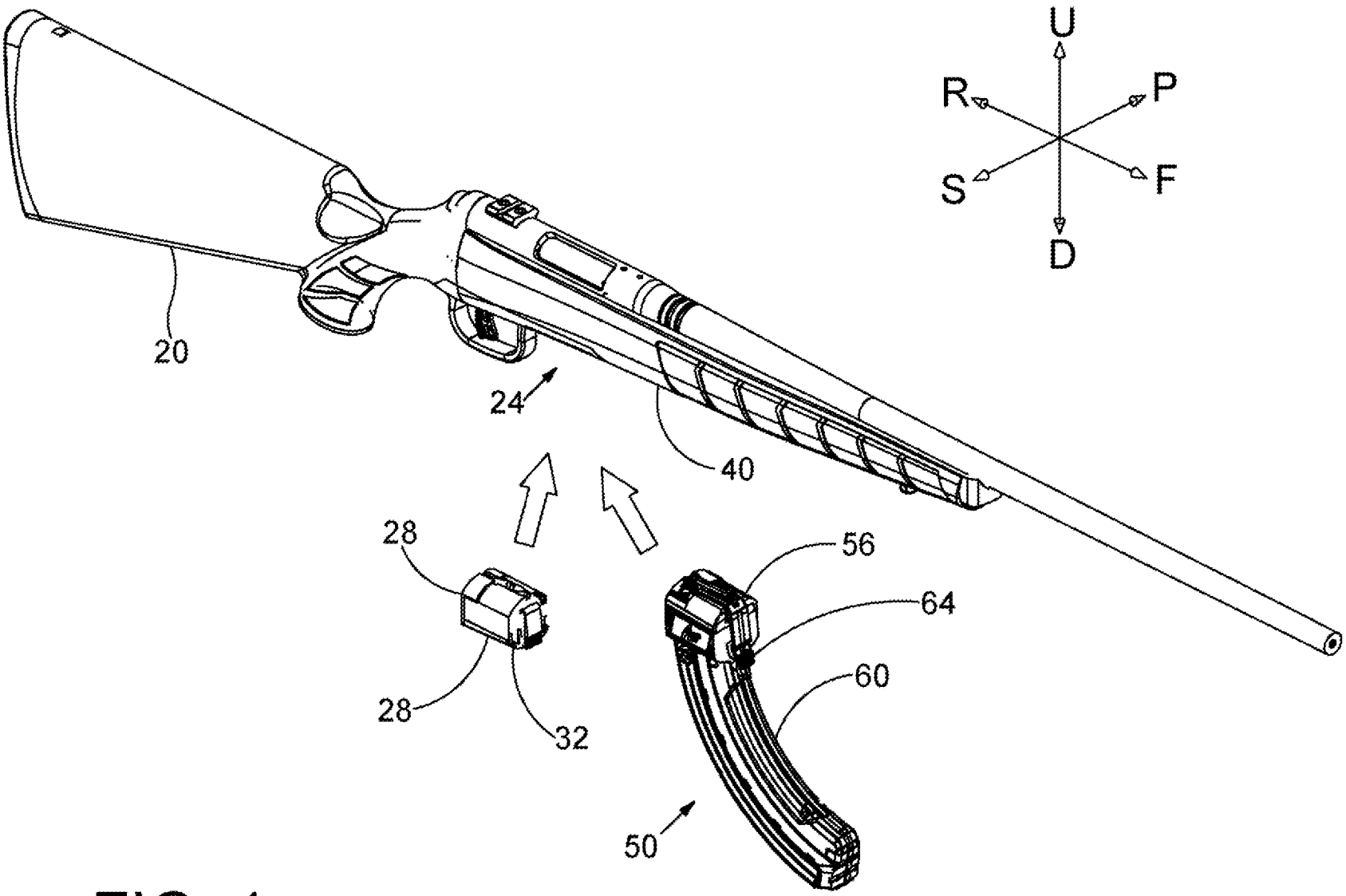
FIG. 1 is perspective view showing a firearm and a magazine in accordance with the detailed description.
Figure 2:
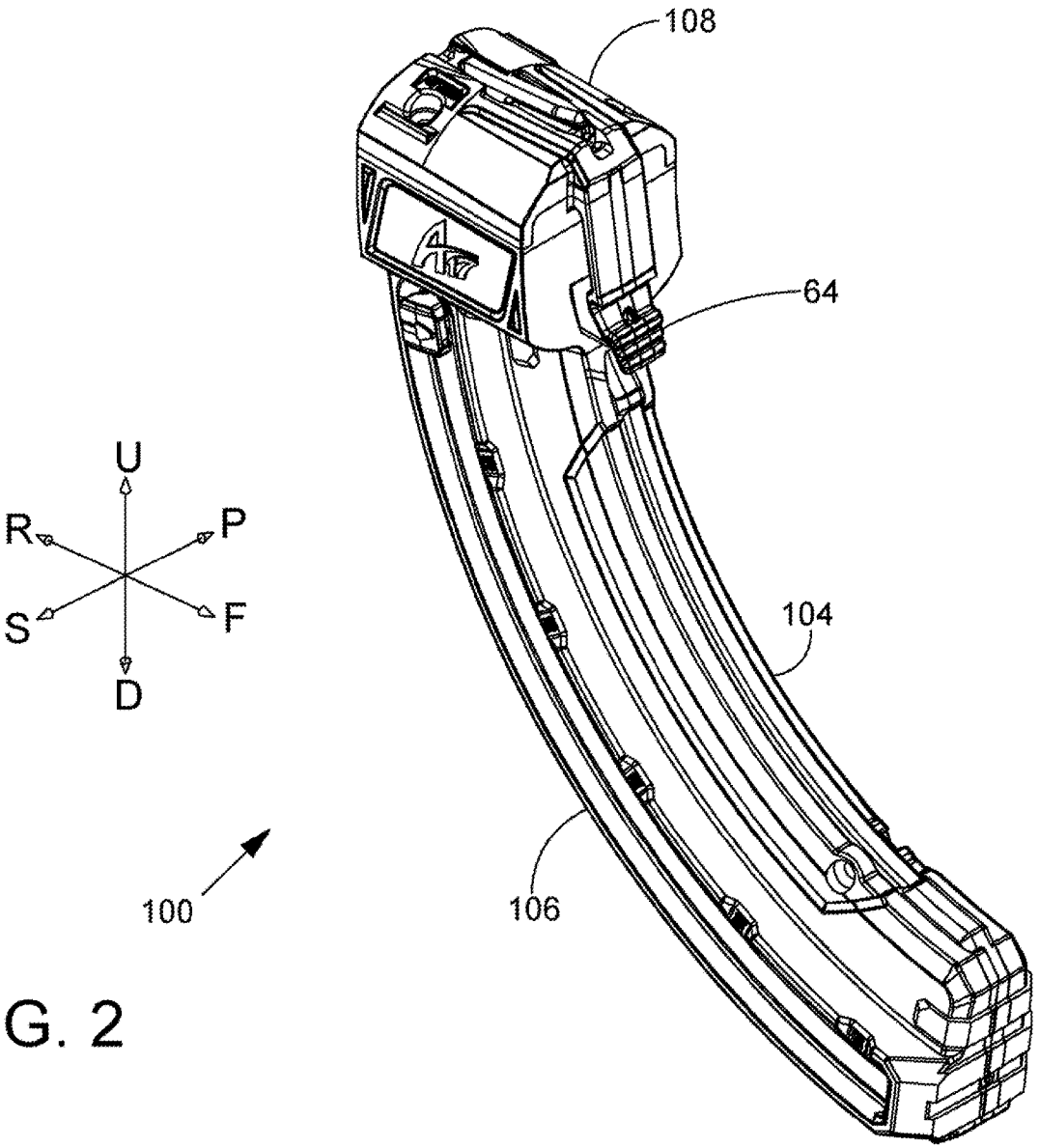
FIG. 2 is an enlarge perspective view of the magazine shown in FIG. 1.
Figure 3:
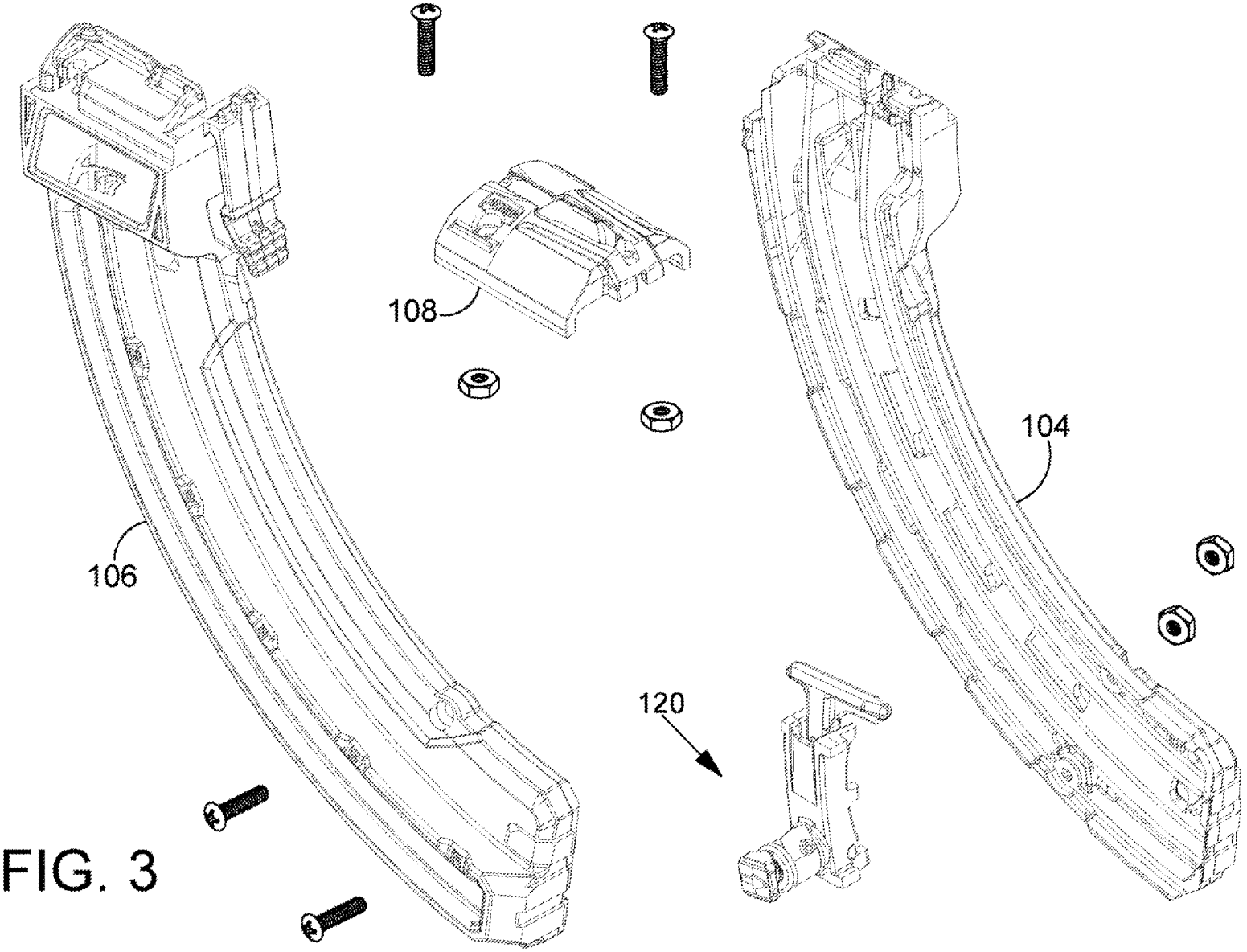
FIG. 3 is an exploded perspective view of the magazine shown in FIG. 2.
Figure 4:
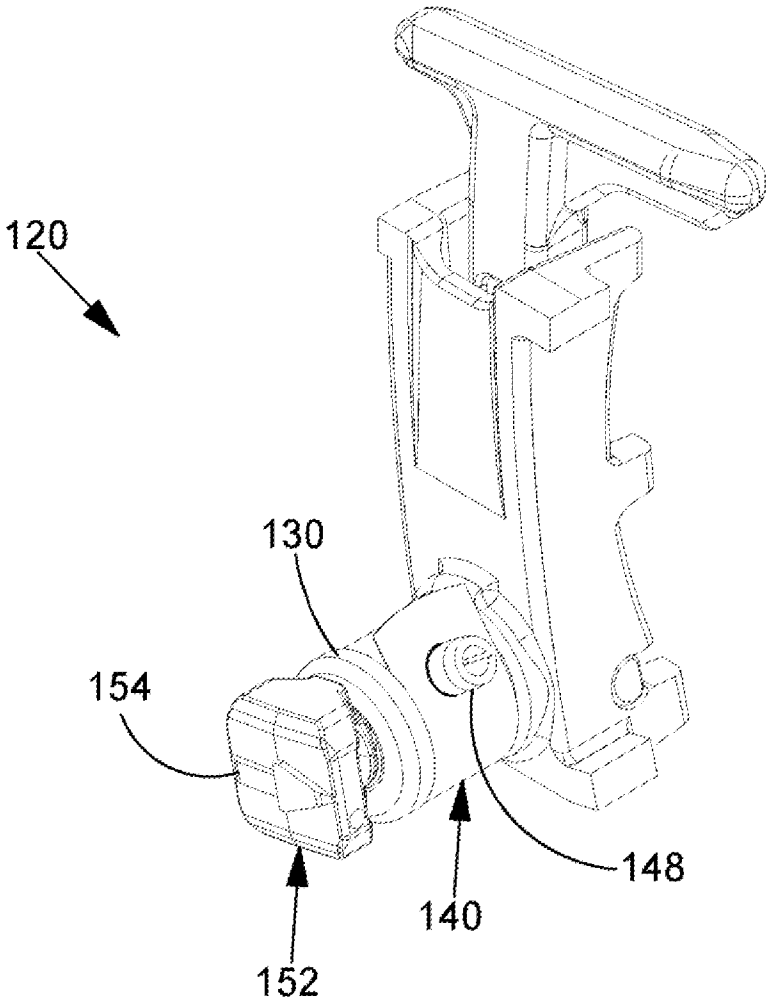
FIG. 4 is a perspective view of a follower assembly.
Figure 5:
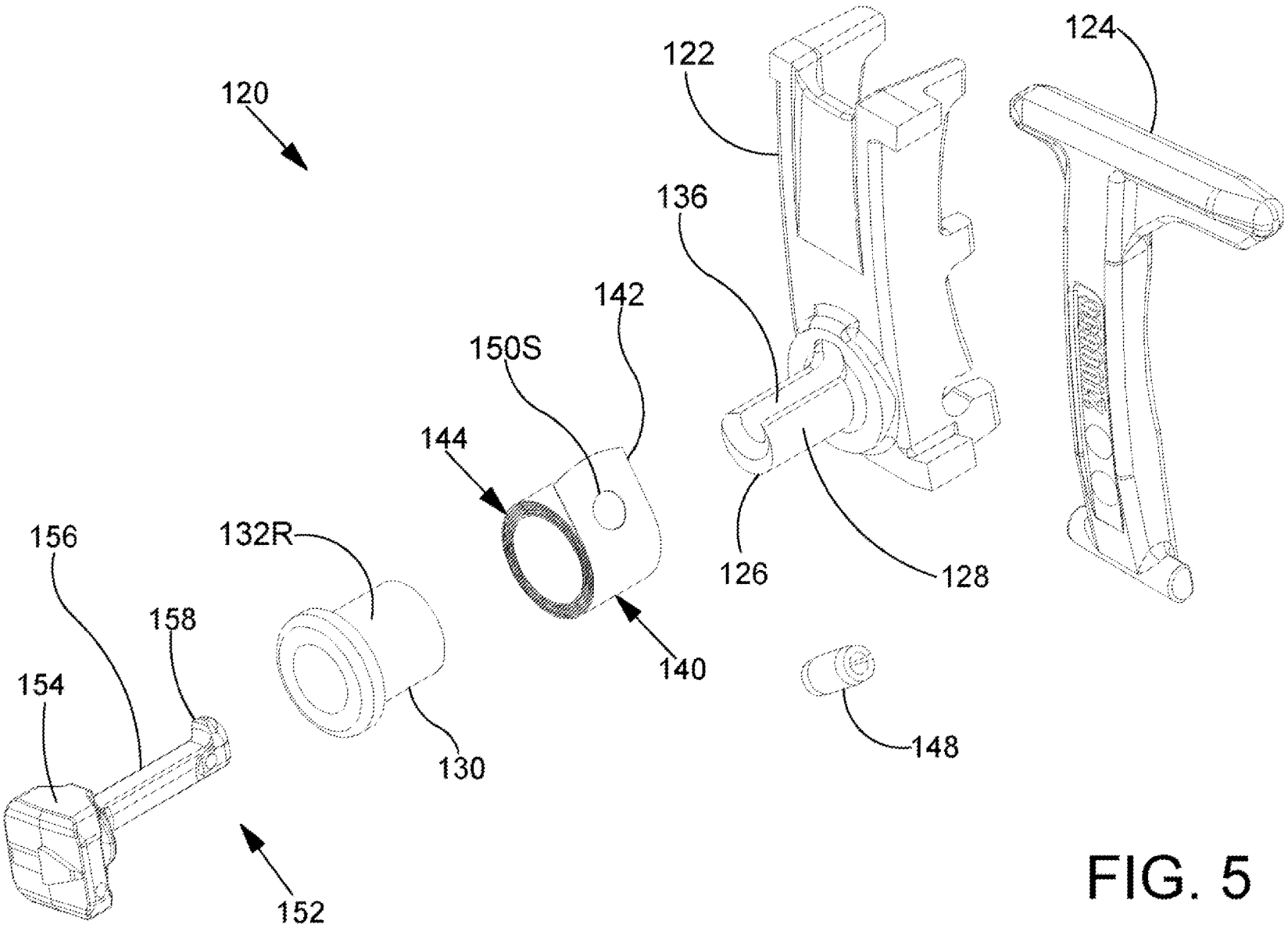
FIG. 5 is an exploded perspective view of the follower assembly shown in FIG. 4.
Figure 6:
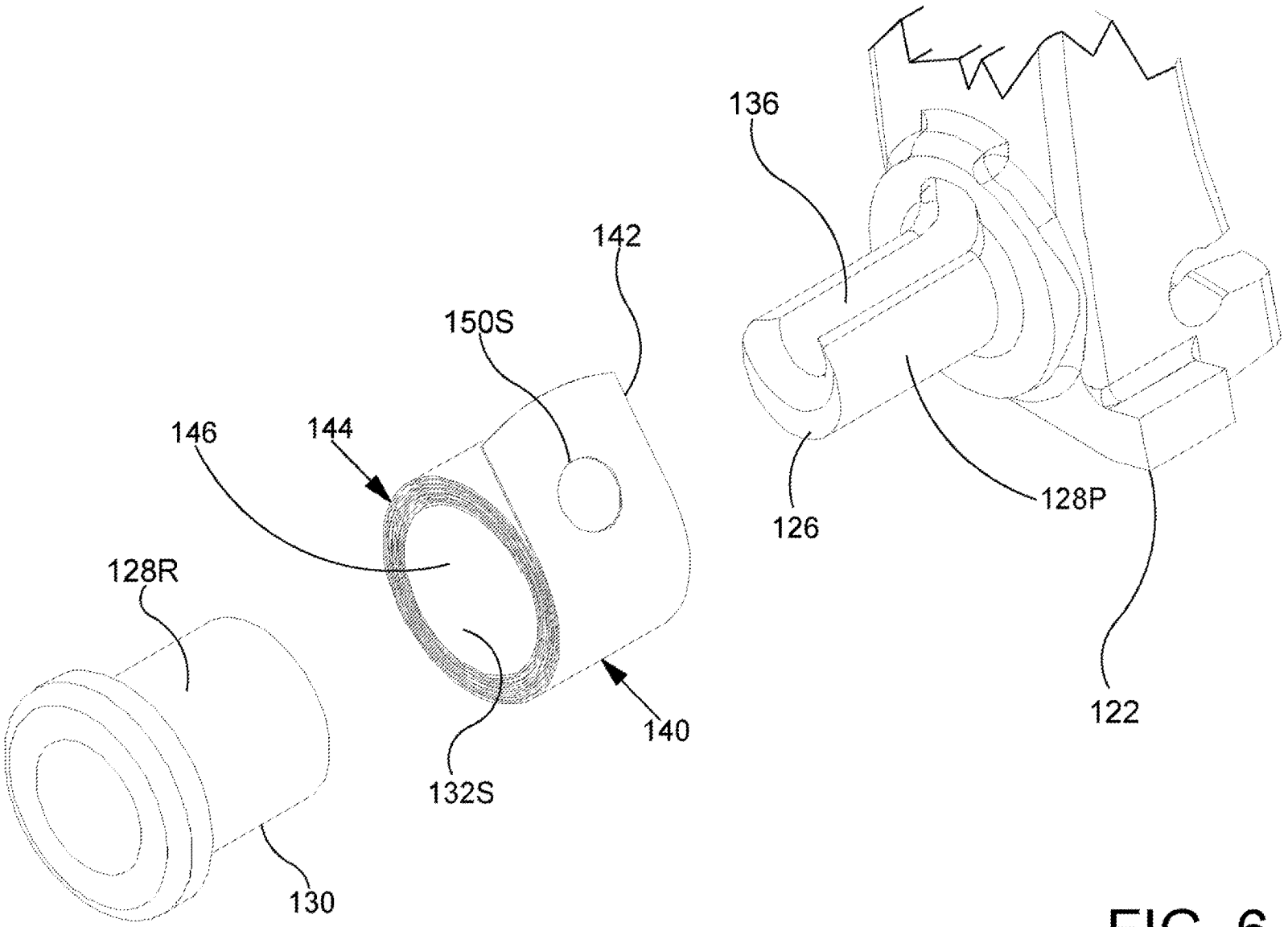
FIG. 6 is an enlarged exploded perspective showing a portion of the follower assembly shown in FIG. 5.

Referring to FIG. 1, a rimfire rifle 20 has a magazine slot 24 for receiving a rotary magazine 28. The rotary magazine being substantially contained within the rifle when inserted with only a lower side 32 and surface 36 of the rotary magazine exposed. The rotary magazine having a latch 34 for retention of the magazine in the magazine slot 24. The lower side and surface of the rotary magazine conforming shapewise to the lower surface 40 of the rifle 20 when inserted. A high capacity magazine 50 has an insertable head portion 56 and an arcuate cartridge bank portion 60. The head portion conforming to the shape of the rotary magazine 28. A latch 64 retains the high capacity magazine in the magazine slot.

Referring to FIGS. 2-19, a magazine 50 for holding and dispensing a plurality of cartridges comprises a magazine body 102 including a port body portion 104 and a starboard body portion 106. The port body portion 104 comprises a front port wall 160, a rear port wall 162, and a port side wall 164 extending between the front port wall 160 and the rear port wall 162. The port body portion 104 further comprises a first port rail 166 and a second port rail 168 that are supported by the port side wall 164. The starboard body portion 106 comprises a front channel wall 180, a rear channel wall 182, and a first starboard side wall 174 extending between the front channel wall 180 and the rear channel wall 182. The inside surfaces of the channel walls define a channel 190 and the starboard side channel wall 184 defines a slot 192 fluidly communicating with the channel 190. The slot 192 extends through the starboard side channel wall 184. The starboard body portion 106 further comprises a front starboard wall 170 and a first starboard side wall 174 that extends between the front starboard wall 170 and the front channel wall 180. The front starboard wall 170 supports a first starboard rail 176 of the starboard body portion 106. The starboard body portion 106 further comprises a rear starboard wall 172 and a second starboard side wall 175 extending between the rear starboard wall 172 and the rear channel wall 182. The rear starboard wall 172 supports a second starboard rail 178 of the starboard body portion 106. The magazine body 102 defines a cartridge receiving volume V that is defined in a first dimension between the front and rear walls of the body portions. The cartridge receiving volume V is defined in a second dimension between a guiding surface the first rail 166 of the port body portion 104 and a guiding surface of the first rail 176 of the starboard body portion 106 and between a guiding surface of the second rail 168 of the port body portion 104 and a guiding surface of the second rail 178 of the starboard body portion 106. A follower assembly 120 is slidingly received in the cartridge receiving volume V defined by the magazine body 102. The follower assembly 120 comprises a follower arm 124 and a follower base 122 that are both slidingly received in the cartridge receiving volume V defined by the magazine body 102. The cartridge receiving volume V extends along an undulating cartridge path P that undulates in a port direction and a starboard direction and the follower arm 124 is pivotally coupled to the follower base 122 so that the follower arm 124 is free to pivot about a pivot axis relative to the follower base 122 as the follower assembly 120 moves along the undulating cartridge path P. The follower base 122 comprises a post portion 126 that extends starboardly into the channel 190 defined by the channel walls of the starboard body portion 106. The magazine 100 includes a user accessible lever 152 comprising a button portion 154, a retaining portion 158, and a shaft portion 156 extending therebetween. The button portion 154 of the user accessible lever 152 is disposed outside of the cartridge receiving volume V. The retaining portion 158 of the user accessible lever 152 engages the base portion 122 of the follower assembly 120. The shaft portion 156 of the user accessible lever 152 extends through the slot 192 defined by the starboard side channel wall 184 and through a groove 136 defined by the post portion 126 of the follower base 122. The follower assembly 120 further comprises a roller 130 disposed about an outer surface 128P of the post and a spring 140 disposed about an outer surface 128R of the roller 130. The spring 140 comprises a ribbon 142 biased to form a roll 144 when the ribbon 142 is in an unstressed state with no external forces acting thereon. An inner surface 132S of the ribbon 142 defines a central opening 146 when the ribbon 142 is free to form the roll 144. A roll end of the ribbon 142 is disposed inside the central opening 146 and a coupled end of the ribbon 142 is coupled to the starboard body portion 106 proximate an upper end thereof. In an embodiment, the coupled end of the ribbon 142 is coupled using a pin 148 that extends through a hole 150S defined by the ribbon 142.

In operation, the ribbon 142 rolls and unrolls during relative translational motion between the follower assembly 120 and the magazine body 102. The inner surface 132S of the ribbon 142 applies an upwardly directed force to the roller 130 and the post 126 of the follower base 122. The upwardly directed force applied to the post 126 of the follower base 122 by the inner surface 132S of the ribbon 142 urges the follower assembly 120 in an upward direction U. The magazine 100 includes a header 108 disposed at an upward ends of the port body portion 104 and the starboard body portion 106. The header 108 defines a cavity 200. An upward portion of the port body portion 104 and an upward portion of the starboard body portion 106 extend into the cavity 200 defined by the header 108.

Figure 7B:
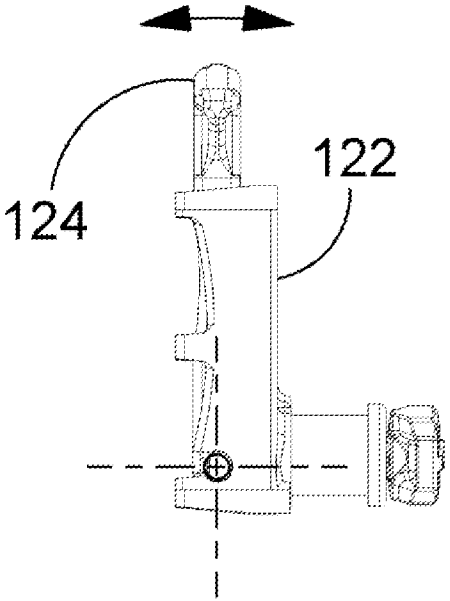
FIG. 7B is a side view of a follower assembly including a follower arm that is pivotally coupled to a follower base so that the follower arm is free to pivot about a pivot axis relative to the follower base.
Figure 7A:
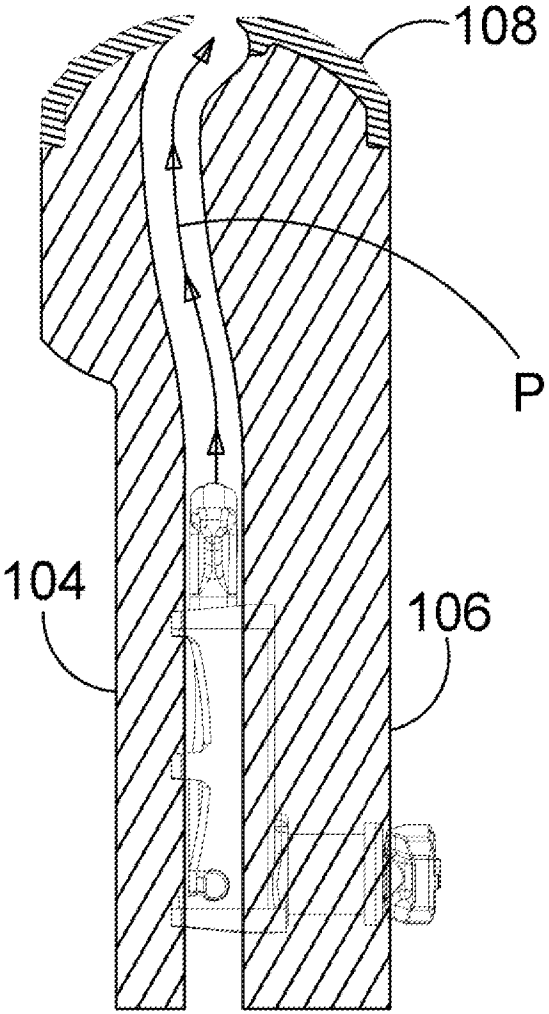
FIG. 7A is a diagram illustrating an undulating cartridge path P that undulates in a port direction and a starboard direction and a follower arm that is pivotally coupled to a follower base so that the follower arm is free to pivot about a pivot axis relative to the follower base as the follower assembly moves along the undulating cartridge path P.
Figure 8B:
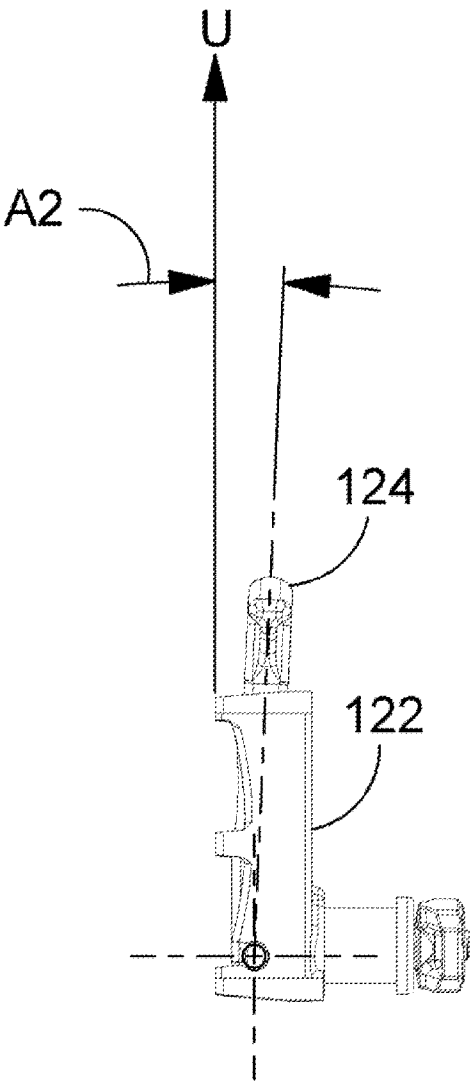
FIG. 8B is a side view of a follower assembly including a follower arm that is pivotally coupled to a follower base so that the follower arm is free to pivot about a pivot axis relative to the follower base.
Figure 8A:
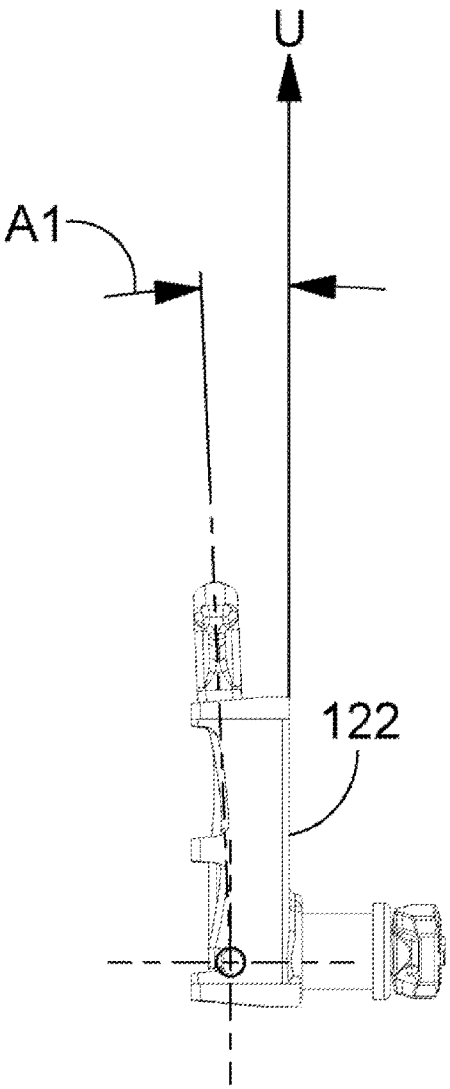
FIG. 8A is a side view of a follower assembly including a follower arm that is pivotally coupled to a follower base so that the follower arm is free to pivot about a pivot axis relative to the follower base.
Figure 9:
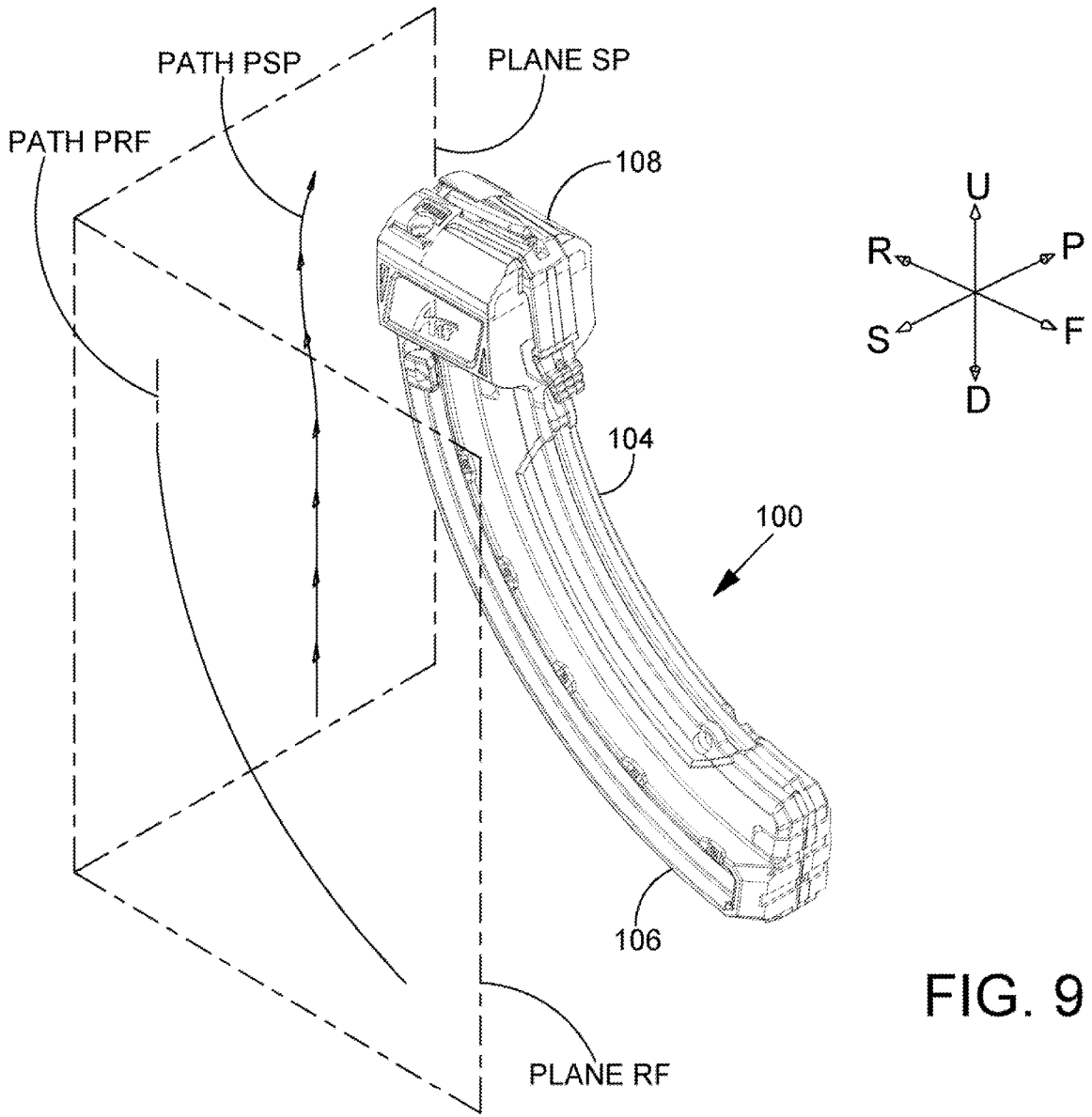
FIG. 9 is a diagram illustrating an undulating cartridge path P that undulates in a port direction and a starboard direction.
Figure 10B:
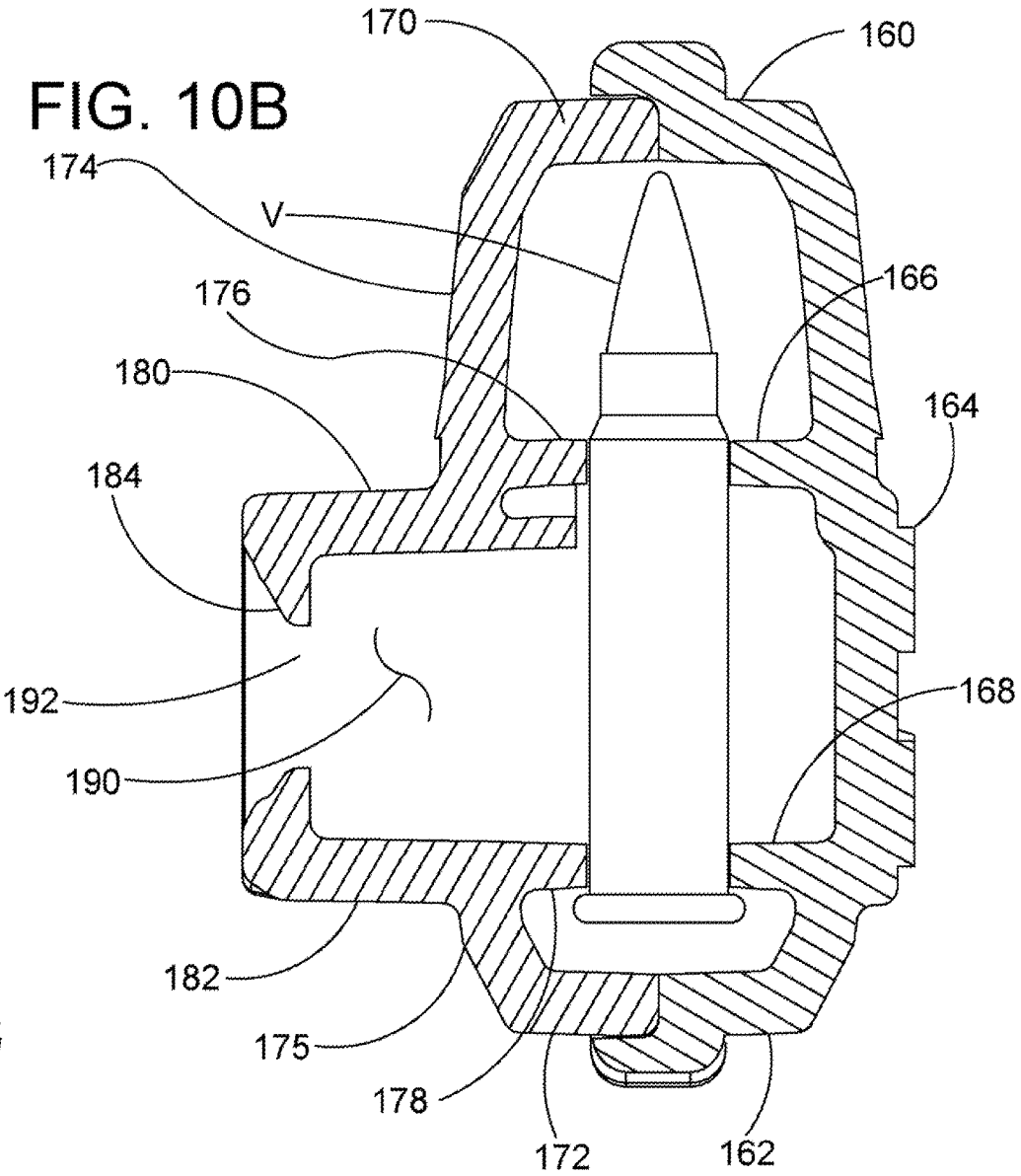
FIG. 10B is section view taken along section line B-B shown in FIG. 10A.
Figure 10A:
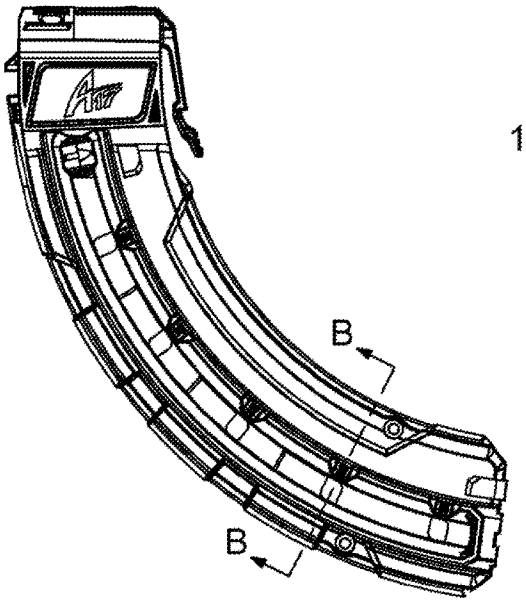
FIG. 10A is a side view of a cartridge magazine in accordance with the detailed description.
Figure 11B:
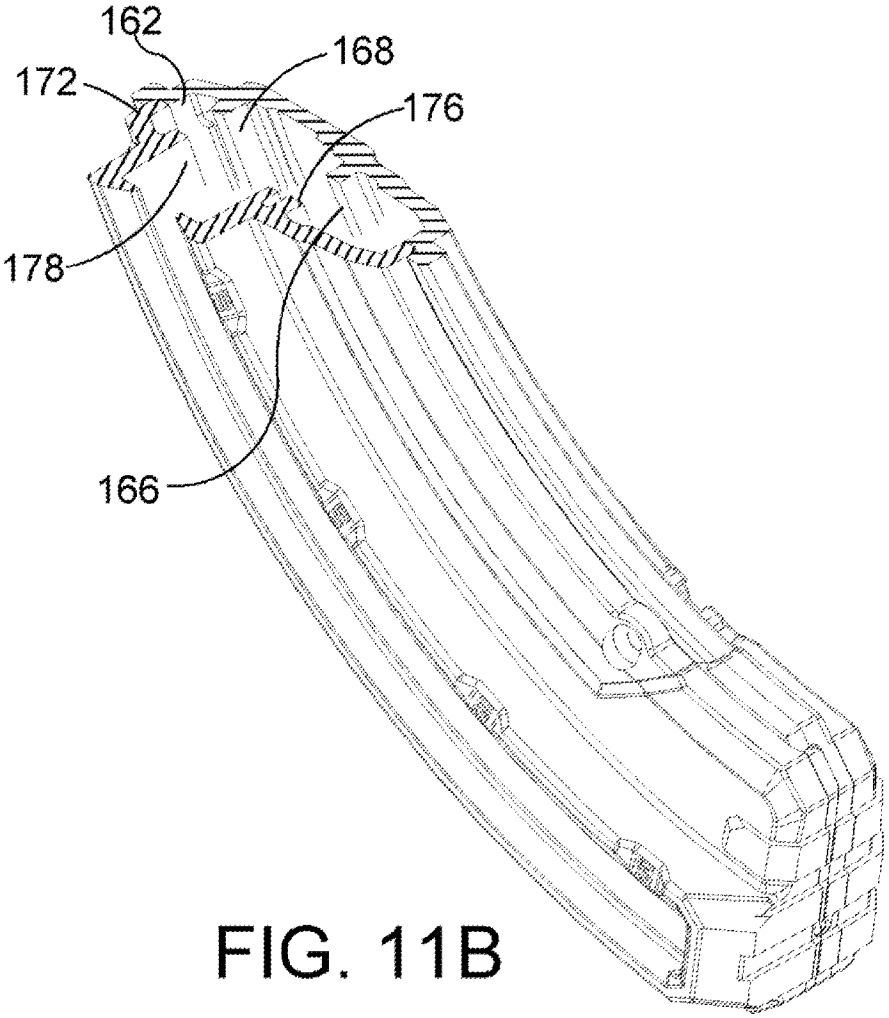
FIG. 11B is a perspective section view of a cartridge magazine in accordance with the detailed description.
Figure 11A:
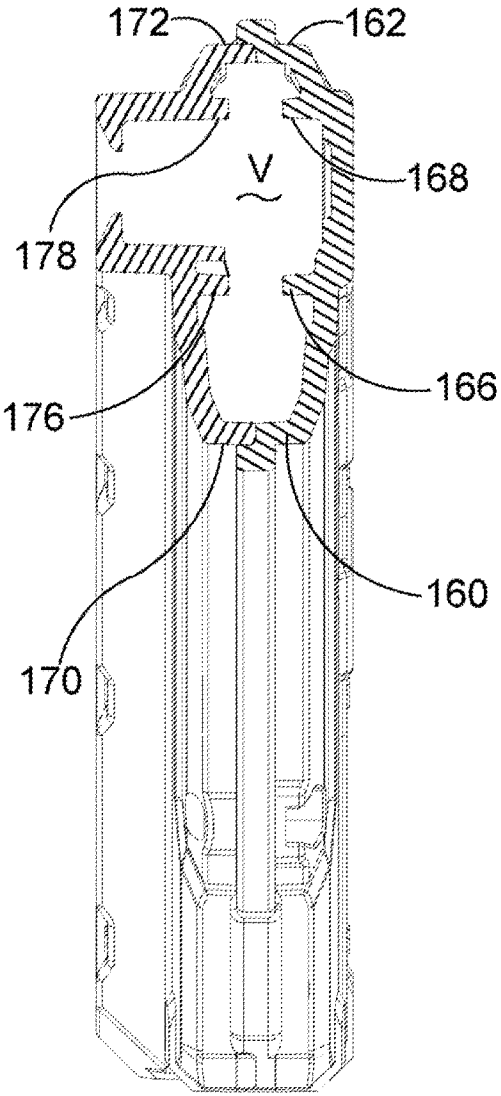
FIG. 11A is a top section view of a cartridge magazine in accordance with the detailed description.
Figure 12:
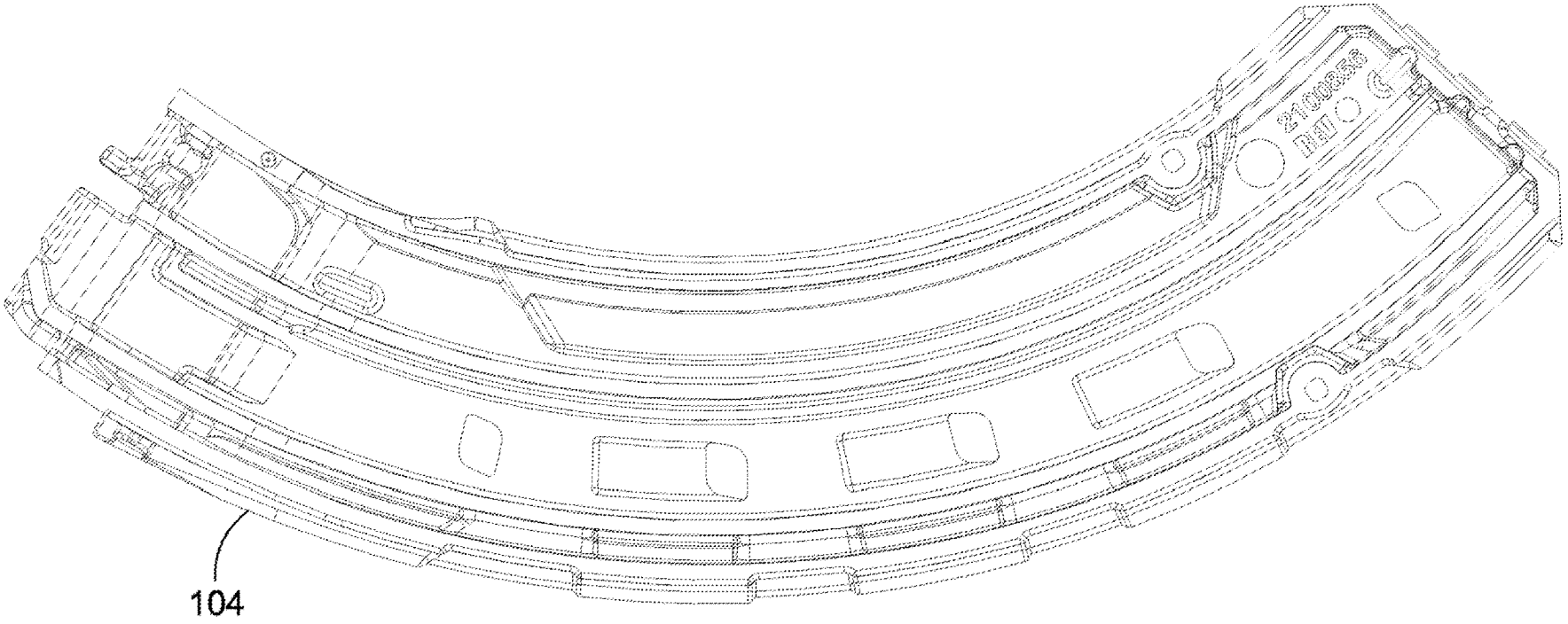
FIG. 12 is a side view showing a port body portion of a cartridge magazine in accordance with the detailed description.
Figure 13:
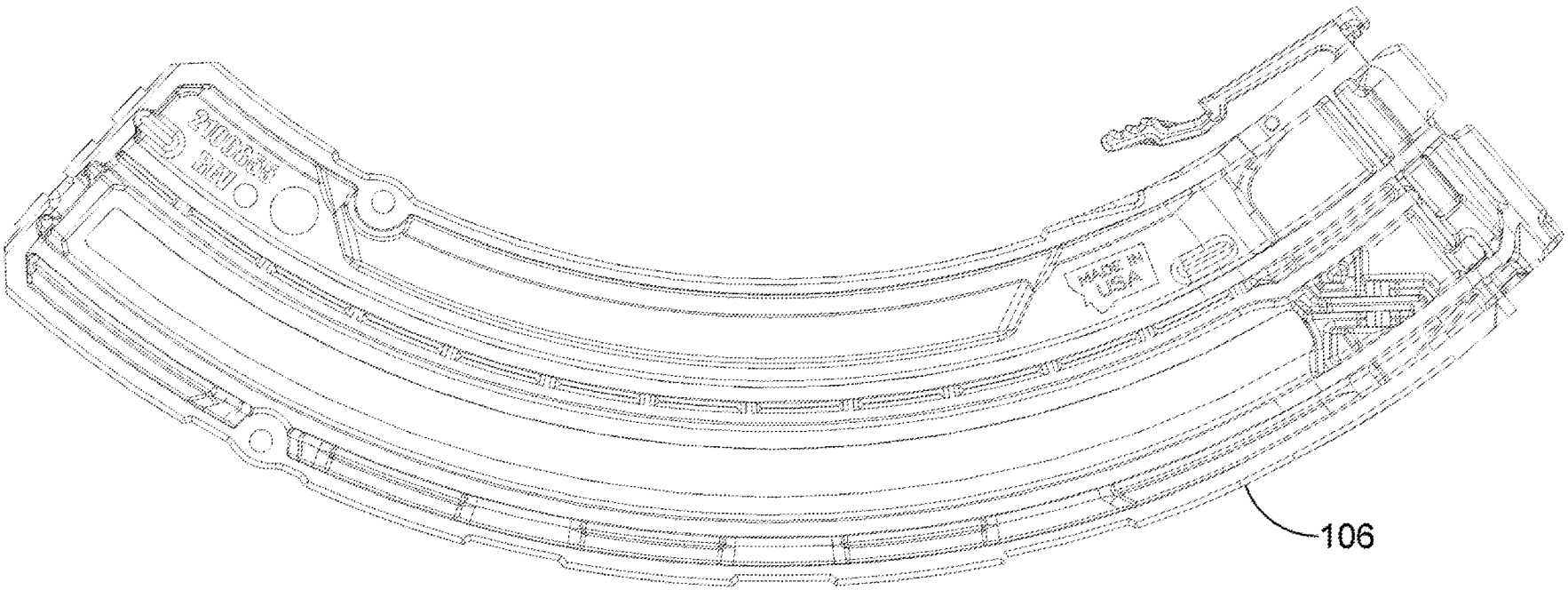
FIG. 13 is a side view showing a starboard body portion of a cartridge magazine in accordance with the detailed description.
Figure 14D:
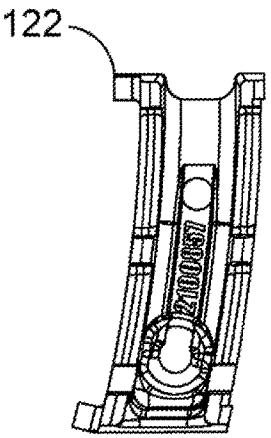
FIGS. 14A-14F are a plurality of plan and elevation views showing a base portion of a follower assembly.
Figure 14C:
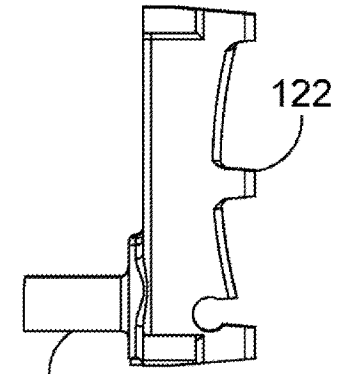
Figure 14B:
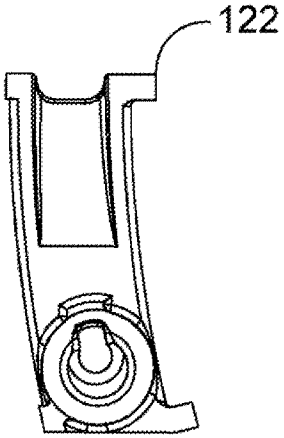
Figure 14F:
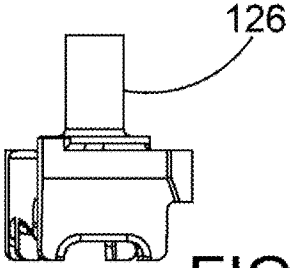
Figure 14A:
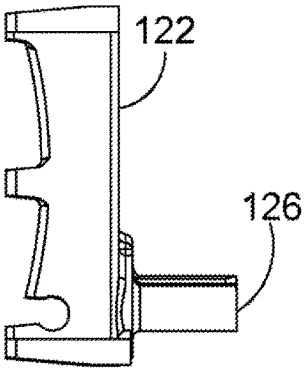
Figure 14E:
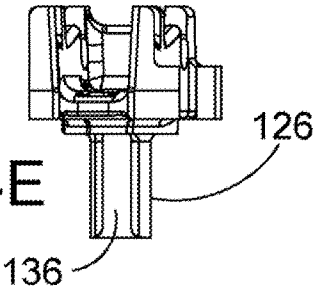
Figure 15D:
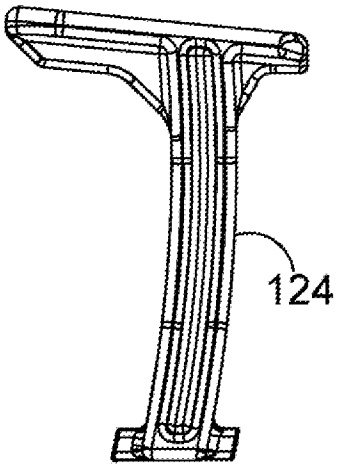
FIGS. 15A-15F are a plurality of plan and elevation views showing a follower arm.
Figure 15C:
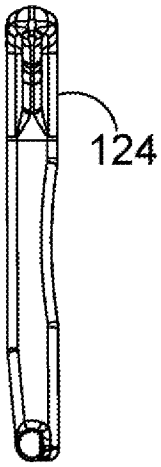
Figure 15E:
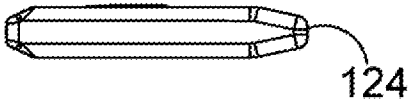
Figure 15B:
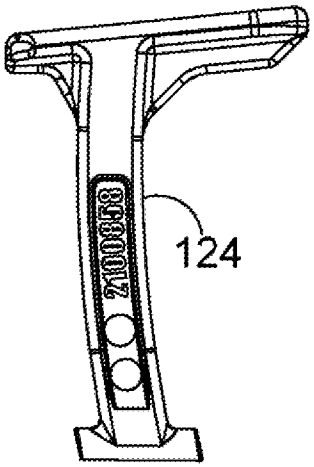
Figure 15F:
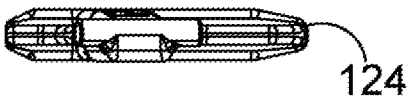
Figure 15A:
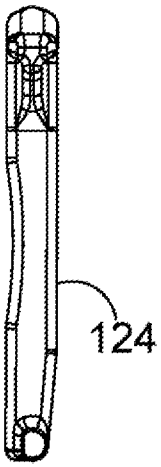

Referring to FIGS. 7-9, a feature and advantage of embodiments is a magazine body defining an undulating path P to be traveled by each cartridge in a stack of cartridges held in the magazine. The undulating nature of the path P traveled by each cartridge may alleviate stack up and presentation issues.

Referring to FIGS. 7-9, a feature and advantage of embodiments is a two piece follower design including a follower arm 124 that is pivotally coupled to a follower base portion 122. This arrangement allows the upper end of the follower arm 124 to travel independently off axis relative to the follower base portion 122 as the follower travels through an undulating path P to be traveled by each cartridge in a stack of cartridges held in the magazine. The ability of the follower arm 124 to pivot relative to the follower base portion 122 increased the ability of the follower to travel along an undulating path P without excessive friction or binding.

Referring to FIGS. 3-6, a feature and advantage of embodiments is a spring 140 that applies a substantially constant upwardly directed feeding for to the base portion of the follower assembly. The spring 140 comprising a ribbon 142 biased to form a roll 144 when the ribbon 142 is in an unstressed state with no external forces acting thereon. An inner surface of the ribbon 142 defining a central opening when the ribbon 142 is free to form the roll 144. A post portion 124 of the follower base portion extends through the central opening of the roll 144 so that the inner surface of the ribbon 142 applies an upwardly directed force to a roller 130 and the outside surface of the post portion 124. In an embodiment, the ribbon 142 is sufficiently thin that the geometry of the roll 144 near the post portion 124 remains nearly constant as the ribbon 142 roll 144*s* and unroll 144*s* and the force applied to the outer surface of the post portion 124 by the inner surface of the ribbon 142 is nearly constant.

Figure 16:
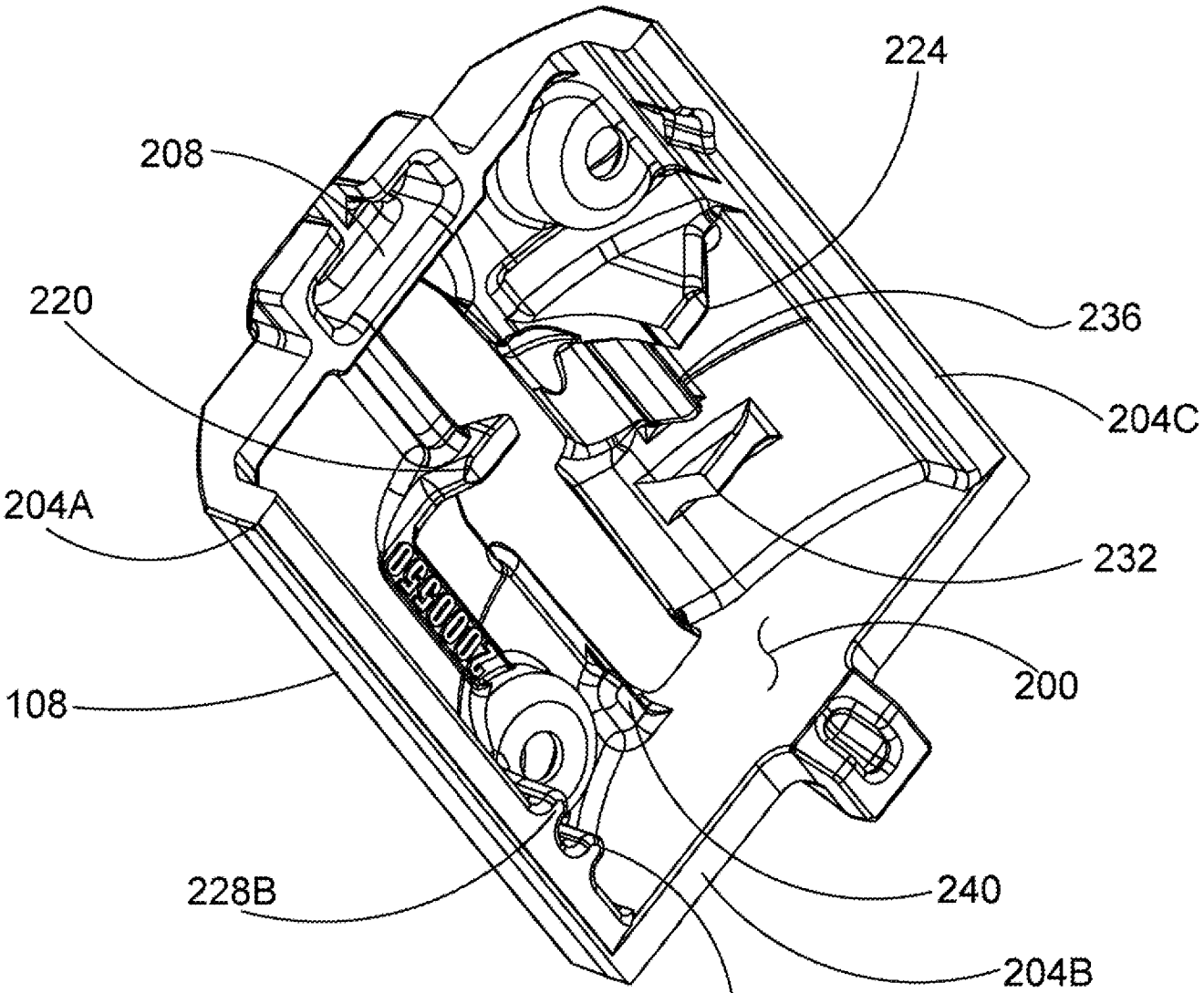
FIG. 16 is a perspective view showing a header of a cartridge magazine in accordance with the detailed description.
Figure 17:
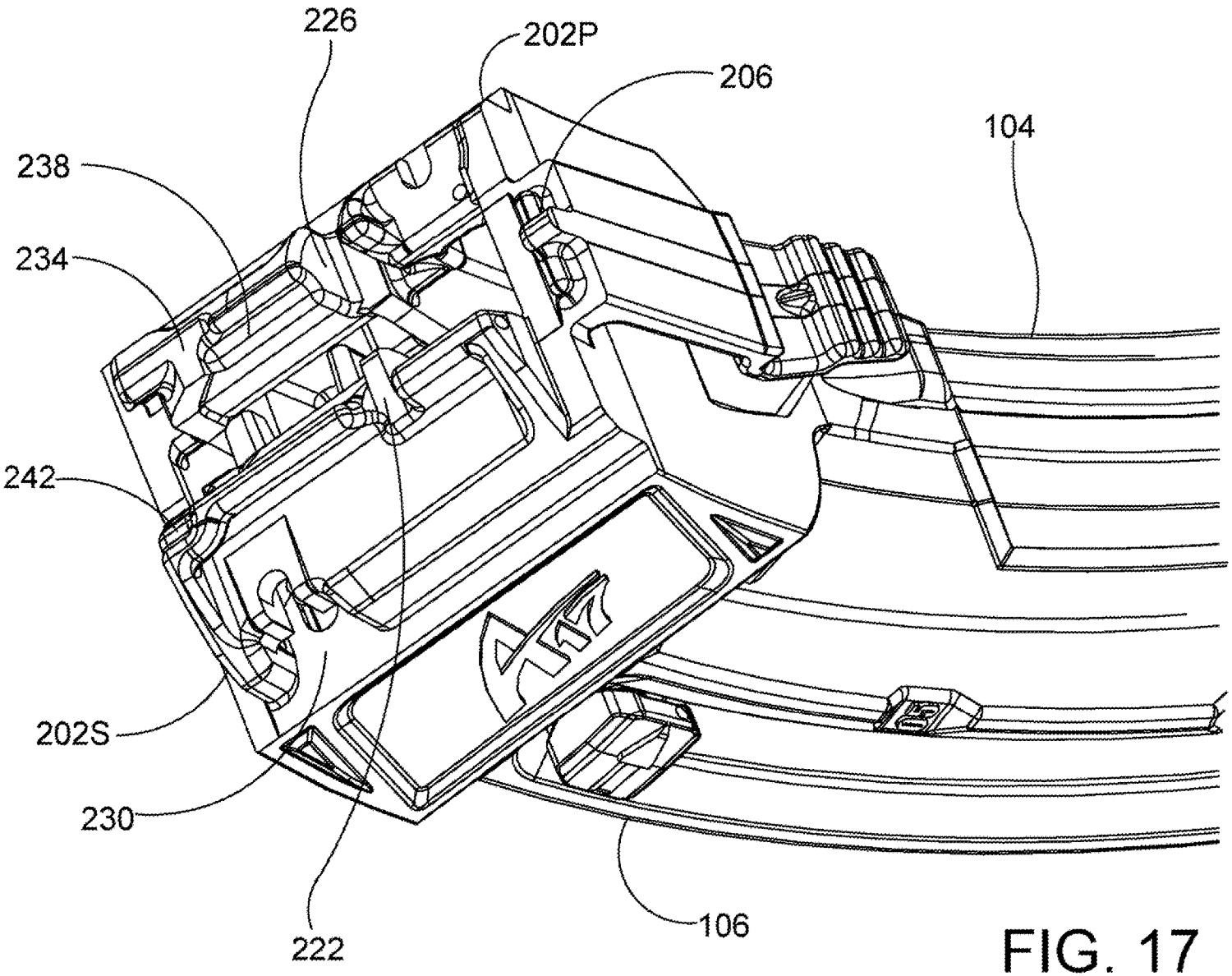
FIG. 17 is a perspective view showing a port body portion and a starboard body portion of a cartridge magazine in accordance with the detailed description.
Figure 18A:
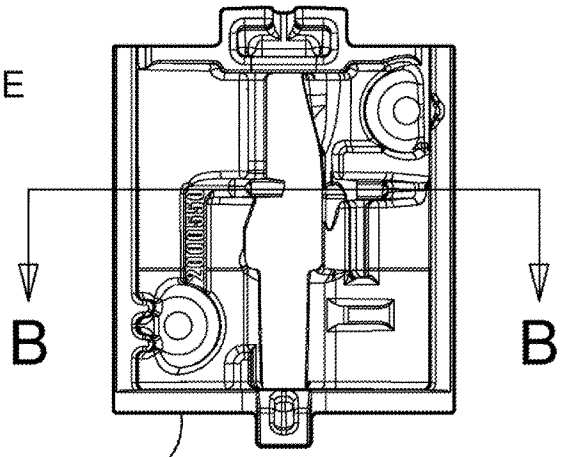
FIG. 18A is a bottom view of a header in accordance with the detailed description.
Figure 18B:
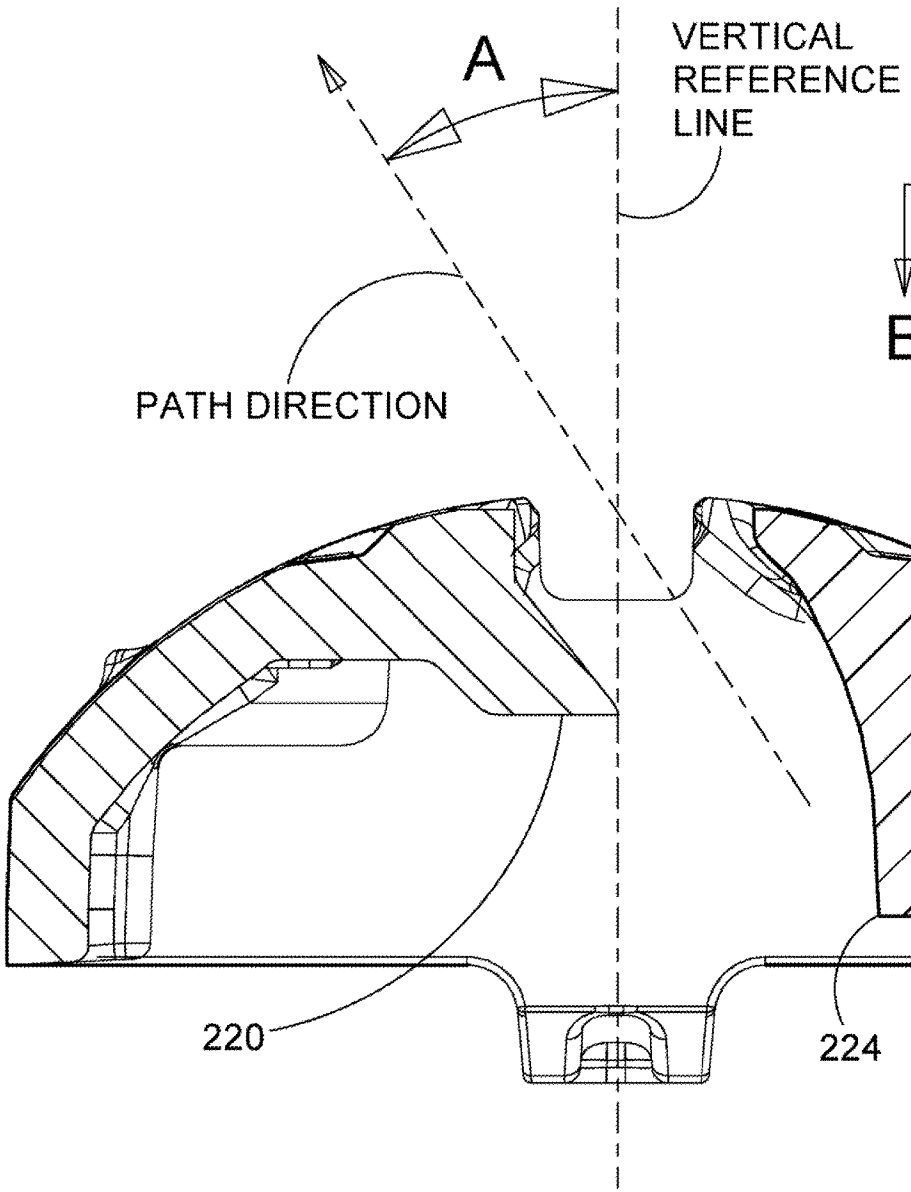
FIG. 18B is a section view a header that has been sectioned along section line B-B shown in FIG. 18A.
Figure 19:
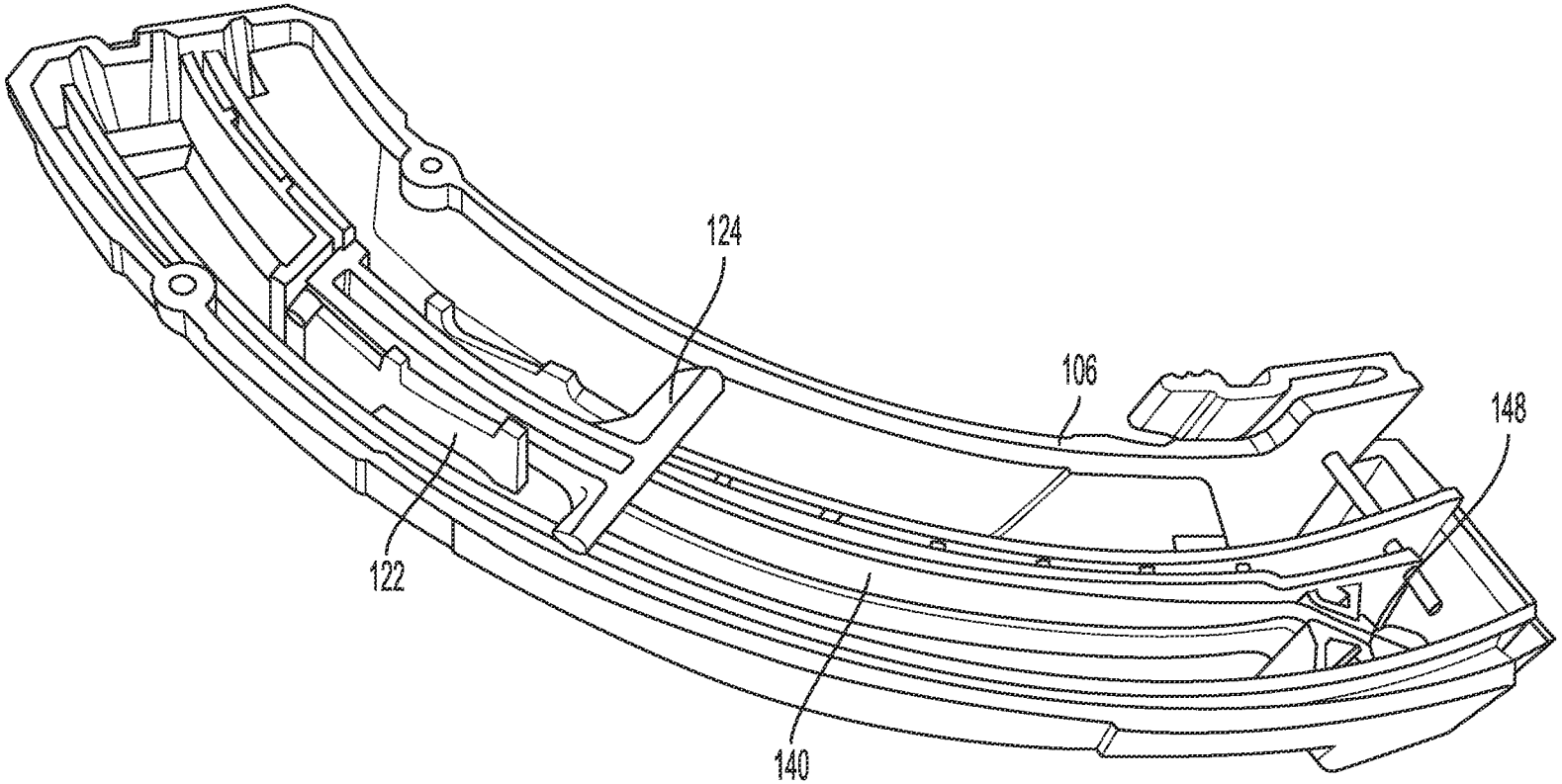
FIG. 19 is a perspective view of an assembly including the starboard body portion shown in FIG. 13.

Referring to FIGS. 16-18, in an embodiment, the header 108 forms a mechanically interlocking engagement with the port body portion 104 and the starboard body portion 106 so as to hold the port body portion 104 and the starboard body portion 106 against one another. Header 108 defines a cavity 200 that is dimensioned and configure to receive an upper protrusion 202P of port body portion 104 and an upper protrusion 202S of starboard body portion 106. Header 108 comprises a starboard header wall 204A, a rearward header wall 204B, a port header wall 204C and a forward header wall 204D. Cavity 200 is partially defined by the starboard header wall 204A, the rearward header wall 204B, the port header wall 204C and the forward header wall 204D.

The starboard body portion 106 comprises a tab 206 and header 108 comprises a corresponding tab receiving feature 208. The tab receiving feature 208 of header 108 is dimensioned and configured to receive the tab 206 of the starboard body portion 106. The header 108 comprises a second guide 222 and starboard body portion 106 comprises a corresponding guide receiving groove 222. The guide receiving groove 222 of the starboard body portion 106 is dimensioned and configured to receive the second guide 222 of the header 108. The header 108 comprises a first guide 224 and the port body portion 104 comprises a corresponding guide receiving channel 226. The guide receiving channel 226 of the port body portion 104 is dimensioned and configured to receive the first guide 224 of the header 108. The header 108 comprises a first rib 228A and a second rib 228B. The starboard body portion 106 includes a rib receiving feature 230 that is dimensioned and configured to receive the first rib 228A and the second rib 228A of the header 108. The header 108 comprises a ledge 232 and the port body portion 104 comprises a corresponding plateau 234. The plateau 234 of the port body portion 104 is dimensioned and configured to support the ledge 232 of the header 108. The header 108 comprises a peak 236 and the port body portion 104 comprises a corresponding valley 238. The valley 238 of the port body portion 104 is dimensioned and configured to receive the peak 236 of the header 108. The header 108 comprises a bar 240 and starboard body portion 106 comprises a corresponding bar receiving feature 242. The bar receiving feature 242 of the starboard body portion 106 is dimensioned and configured to receive the bar 240 of the header 108.

In some embodiments, a first guide 224 is fixed to the upper header wall, the first guide 224 extending downwardly beyond a downward facing surface of the upper header wall. In some embodiments, the first guide 224 extends downward into a guide receiving channel defined by the body portion, the guide receiving channel being dimensioned and configured to receive the first guide 224. In some embodiments, the first guide 224 has a maximum guide length extending in the portward and starboard directions and a maximum guide width extending in the forward and rearward directions. The maximum guide length is greater than the maximum guide width in some embodiments.

In some embodiments, a first guide 224 and a second guide 220 are fixed to the upper header wall. The guides may extend downwardly beyond a downward facing surface of the upper header wall. In some embodiments, the first guide 224 and the second guide 220 conduct cartridges along an exit path between the cartridge receiving volume and the exit opening. In some embodiments, the exit path extends in a path direction disposed at an angle relative to a vertical reference axis, the vertical reference axis extending in upward and downward directions.

A magazine for holding and dispensing a plurality of cartridges in accordance with some embodiments comprises a header 108 and a magazine body. The header comprises a starboard header wall 204A disposed opposite a port header wall 204C and a front header wall 204D extending between a forward end of the starboard header wall 204A and a forward end of the port header wall 204C. The header may also include a rearward header wall 204B extending between a rearward end of the starboard header wall 204A and a rearward end of the port header wall 204C.

In some embodiments, the header also includes an upper header wall extending between an upper portion of the starboard header wall 204A and an upper portion of the port header wall 204C. The header walls define a header cavity and the upper header wall defining an exit opening communicating with the header cavity in some embodiments. In some embodiments, the magazine body defines a cartridge receiving volume communicating with the exit opening. The magazine body may include a starboard body portion 106 and a port body portion 104, an upper portion of each body portion extending into the header cavity with the starboard header wall 204A and the port header wall 204C securing the body portions against each other.

Referring to FIGS. 1-19, a high capacity magazine 100 for rimfire cartridges in accordance with some embodiments comprises a pair of clam shell portions couplable together. When coupled, the clam shell portions 104, 106 define and arcuate cartridge bank volume V and have a pair of upper ends that define a lower portion of the head portion. In some embodiments, the high capacity magazine 100 comprises a header 108 that caps the upper ends of the pair of clam shell portions 104, 106 thereby securing the clam shell portions 104, 106 together. In some embodiments, the high capacity magazine 100 comprises a slider assembly 120 with a cartridge pusher 124 positioned in the cartridge bank volume V and with an externally viewable capacity indicator 154, and a spring 140 connecting between a portion 122 of the slider assembly 120 and one of the head portion and the arcuate cartridge bank volume V for causing a bias of the slider assembly 120 toward the head portion thereby urging a stack of cartridges in the cartridge bank volume V toward a cartridge exit opening defined by the header 108.

FIG. 1 is perspective view showing a firearm 20 and a magazine 100. In FIG. 1, an upward direction U and a downward direction D, are illustrated using arrows labeled "U" and "D." A forward direction F and a rearward direction R, are illustrated using arrows labeled "F" and "R," respectively, in FIG. 1. A starboard direction S and a port direction P are illustrated using arrows labeled "S" and "P," respectively, in FIG. 1. In the embodiment of FIG. 1, these directions may be conceptualized from the point of view of a user who is holding the firearm F.

Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portly," and "starboardly," should not be interpreted to limit the scope of the invention recited in the attached claims.

The following United States patents are hereby incorporated by reference herein: U.S. Pat. Nos. 2,765,558, 2,777,235, 3,087,270, 3,577,860, 4,127,954, 4,566,212, 4,580,364, 4,672,760, 4,765,081, 4,776,122, 4,790,094, 4,888,899, 5,502,913, 7,011,028, 8,407,922, 8,991,086, 5,301,449, 4,939,862, 4,739,572, 3,239,959.

The above references to U.S. patents in all sections of this application are herein incorporated by references in their entirety for all purposes. Components illustrated in such patents may be utilized with embodiments herein. Incorporation by reference is discussed, for example, in MPEP section 2163.07(B).

United States patents issuing from the following published United States patent applications are hereby incorporated by reference herein: US20150330727, 20150330734 and 20150330731. The following published United States patent applications are also hereby incorporated by reference herein: US20150330727, 20150330734 and 20150330731.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A magazine for holding and dispensing a plurality of cartridges, comprising:

a magazine body including a first body portion and a second body portion, the magazine body defining a cartridge receiving volume in the magazine body that extends along a cartridge path;

the second body portion comprising a first wall, a second wall, and a third wall extending between the first wall and the second wall, the second body portion further comprising a first rail and a second rail that are supported by the second wall;

the first body portion comprising a first channel wall, a second channel wall, and a third channel wall extending between the first channel wall and the second channel wall, wherein inside surfaces of the first and second channel walls define a channel and the third channel wall defines a slot communicating with the channel;

a header disposed proximate to an end of the first body portion and the second body portion, the header defining a depression, the end of the first body portion and the second body portion extending into the depression defined by the header;

a follower assembly comprising a follower arm and a follower base that are slidingly received in the cartridge receiving volume, the follower arm is pivotally coupled to the follower base so that the follower arm is free to pivot about a pivot axis relative to the follower base as the follower assembly moves along the cartridge path;

the follower base comprising a post portion extending into the channel walls of the first body portion, a user-accessible lever comprising a button portion, a retaining portion, and a shaft portion extending therebetween, the button portion of the user-accessible lever being disposed outside of the magazine body, the retaining portion of the user-accessible lever engaging the base portion of the follower assembly, the shaft portion of the user-accessible lever extending through the slot defined by the third channel wall and through a groove defined by the post portion of the follower base; and the follower assembly further comprising a roller disposed about an outer surface of the post and a spring disposed about an outer surface of the roller.

2. The magazine of claim 1 wherein the cartridge path has an arcuate shape.

3. The magazine of claim 1 wherein the header comprises a metal material and each of the first body portion and second body portion comprise a polymer material.

4. The magazine of claim 1 wherein the spring comprising a ribbon biased to form a roll when the ribbon is in an unstressed state with no external forces acting thereon.

5. The magazine of claim 4 wherein the ribbon rolls and unrolls during relative translational motion between the follower assembly and the magazine body.

6. The magazine of claim 1 wherein the header has a cartridge exit slot disposed therein.

7. The magazine of claim 1 wherein the first body portion and second body portion comprise clam shell portions that are couplable together to form the cartridge receiving volume.

* * * * *